United States Patent [19]

Bonaventure et al.

[11] Patent Number: 4,910,889

[45] Date of Patent: Mar. 27, 1990

[54] SKI BOOT LINER

[75] Inventors: Laurent Bonaventure, Annecy; Michel Mabboux, Seynod, both of France

[73] Assignee: Salomon, S.A., Annecy, France

[21] Appl. No.: 262,806

[22] Filed: Oct. 26, 1988

[30] Foreign Application Priority Data

Nov. 6, 1987 [FR] France ..... 87 15804

[51] Int. Cl.[4] ..... A43B 5/04; A43B 17/02; A43B 17/14

[52] U.S. Cl. ..... 36/117; 36/10; 36/71; 36/119; 12/142 P

[58] Field of Search ..... 36/55, 117–121, 36/88, 93, 71, 10; 12/142 P; 264/222, 223

[56] References Cited

U.S. PATENT DOCUMENTS

| | | | |
|---|---|---|---|
| 3,798,799 | 3/1974 | Hanson et al. | 36/119 |
| 3,834,044 | 9/1974 | McAusland et al. . | |
| 3,925,916 | 12/1975 | Garbuio | 36/71 |
| 4,160,332 | 7/1979 | Salomon | 36/119 |
| 4,182,056 | 1/1980 | Dalebout . | |
| 4,414,762 | 11/1983 | Salomon et al. | 36/117 |
| 4,499,675 | 2/1985 | Perotto | 36/119 |
| 4,523,392 | 6/1985 | Gabrielli | 36/10 |
| 4,719,063 | 1/1988 | White | 264/222 |
| 4,790,082 | 12/1988 | Pozzebon | 36/119 |

FOREIGN PATENT DOCUMENTS

| | | | |
|---|---|---|---|
| 8211096 | 8/1982 | Fed. Rep. of Germany . | |
| 1412280 | 12/1965 | France . | |
| 2056381 | 5/1971 | France . | |
| 2107590 | 5/1972 | France . | |
| 2345097 | 10/1977 | France . | |
| 2540352 | 1/1985 | France | 36/117 |
| 79/00770 | 10/1979 | PCT Int'l Appl. . | |
| 626793 | 12/1981 | Switzerland | 36/117 |
| 654467 | 2/1986 | Switzerland | 36/119 |

*Primary Examiner*—James Kee Chi

*Attorney, Agent, or Firm*—Sandler & Greenblum

[57] ABSTRACT

A boot liner, preferably for use with a ski boot of the rear-entry type, including an exterior envelope and an interior sock, having an injection cavity therebetween. Within the injection cavity, a filling product is designed to be injected for retaining the foot of the skier within the boot liner and within the ski boot within which it is adapted to be used. The exterior envelope and the interior sock are sealed along a lower peripheral edge defining a sole portion of the boot liner. The peripheral edge is engageable within a peripheral groove in the internal wall of the exterior envelope to thereby seal the injection cavity from the sole portion of the boot liner to thereby prevent the filling product from flowing beneath the sole of the foot positioned within the boot liner. The injection cavity is defined by respective surfaces of the external envelope and the interior sock. The surface of the interior sock adjacent the cavity is coated with a anti-friction film which is micro-porous for permitting the escape of residual air within the cavity as the filling product is injected therein, while retaining the filling product. Further, the surface or the exterior envelope adjacent the cavity includes a plurality of peripheral ribs which direct the flow of the filling product from the injection orifice toward remote portions of the cavity. Maintenance means and foot retention means can be used in conjunction with the boot liner of the present invention.

57 Claims, 5 Drawing Sheets

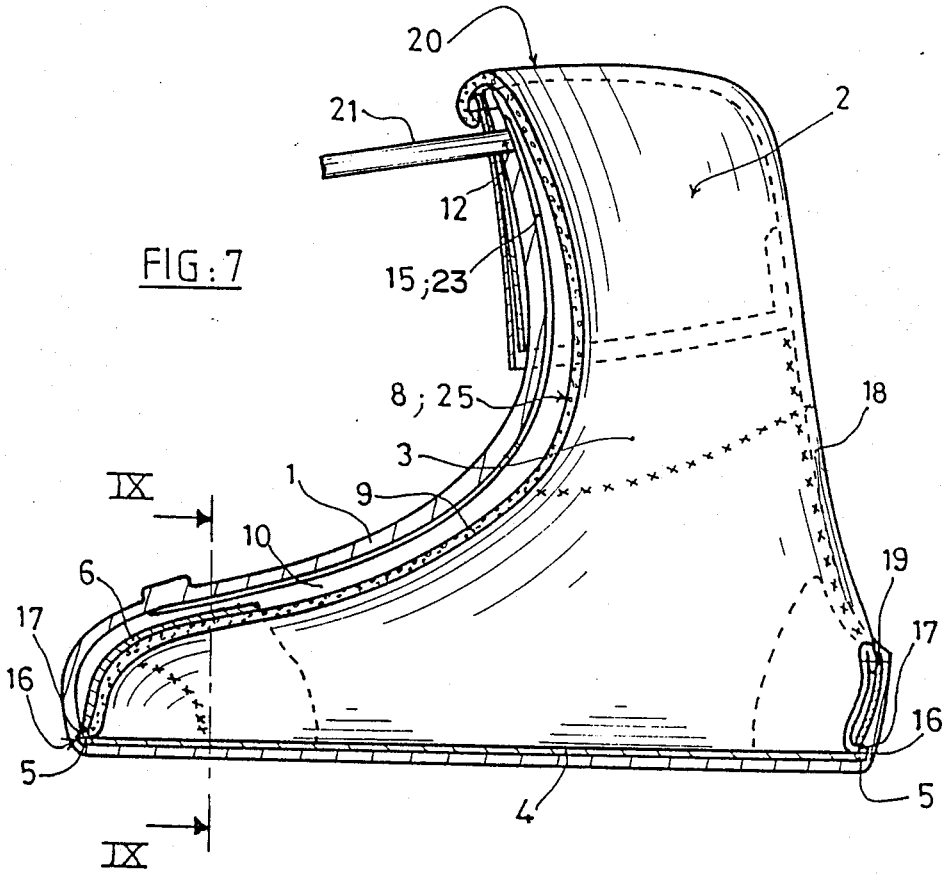
FIG: 7
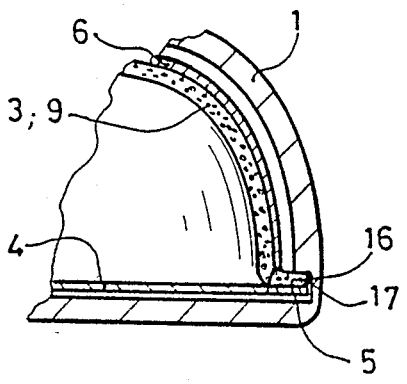
FIG: 9
FIG: 8
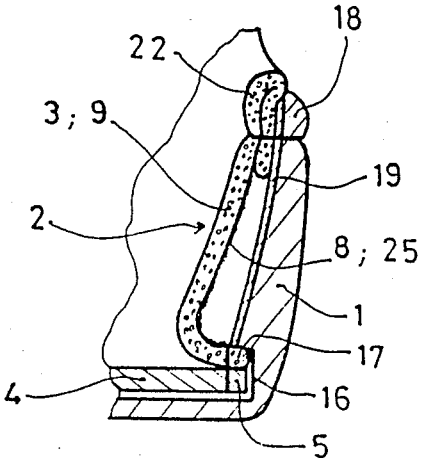

FIG.11
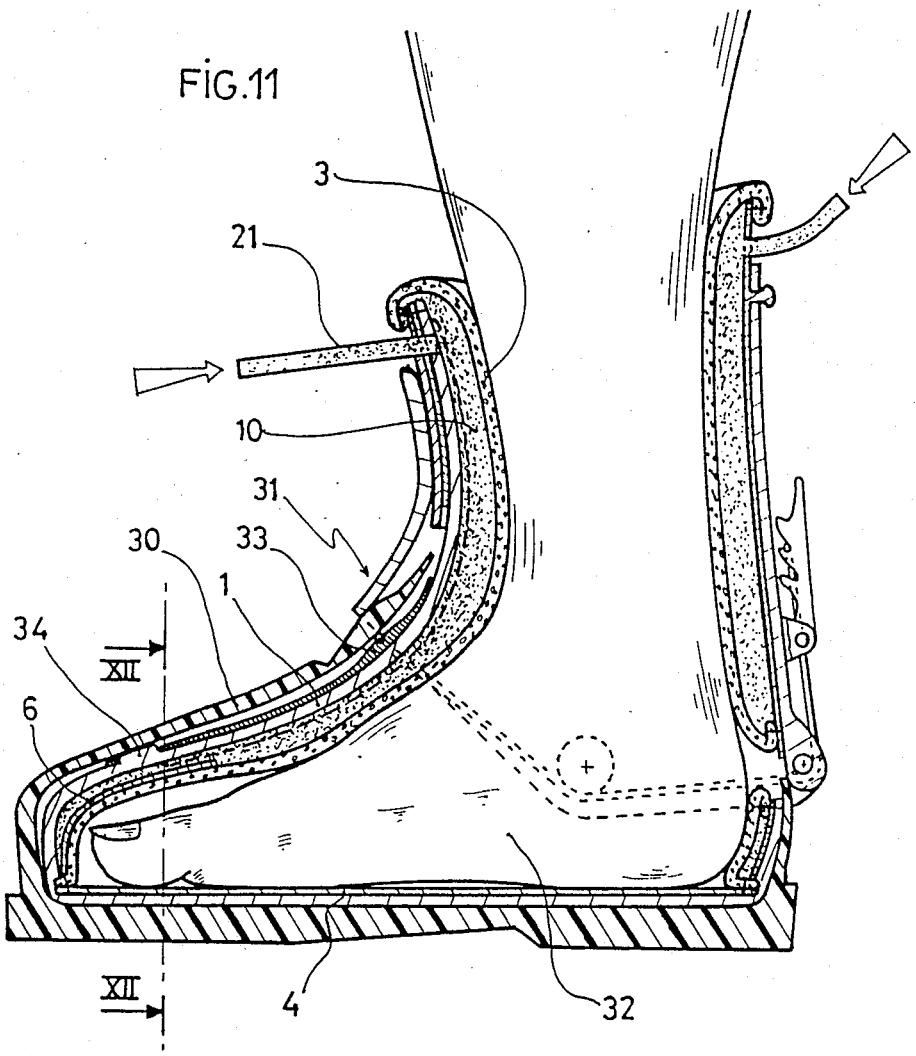
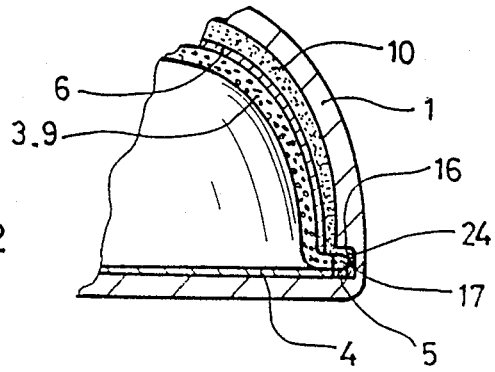
FIG.12

SKI BOOT LINER

BACKGROUND OF THE INVENTION

1. Field of the Invention

The present invention relates to internal liners or booties of ski boots and relates, more particularly, to liners whose adaptability to the foot of the skier is achieved by means of a product injected into at least one cavity with which the liners are provided and which corresponds to the tightening and/or retention zone of the foot.

2. Description of Background and Relevant Information

Ski boot liners of this type most often include a cavity or a pocket, defined by an external and an internal wall for injection of a filling product. At least the internal wall is relatively flexible and/or deformable to conform to the corresponding zone of the foot of skier under the effect of the pressure of the injected product. To ensure the optimum retention of the foot, various embodiments of liners and/or of adjustments of the foot in the boot have been proposed in the prior art. Thus, certain embodiments present, in particular, an integral adjustment of the internal wall of the liner around the foot, while other embodiments are directed, instead, towards the tightening zones on the foot.

Thus, for example, French Patent No. 2,056,381 describes a liner constituted by two envelopes nested within one another, the internal envelope being adapted to receive and to integrally envelope the foot, while the external envelope is adapted to adjust itself to the corresponding space provided in the boot. The injection of the product occurs after the introduction of the foot in the liner which makes it possible to obtain a tight application of the liner on the foot by ensuring, in particular, adjustment of the internal envelope to the morphology of the plantar surface of the skier. Such an adjustment is, however, sometimes the cause of certain discomforts such as cramps and numbness. In effect, due to the variations of the deformation of the foot under load being blocked in the plantar support zone, localized compressions occur on the portions of the foot subjected to the deformations, for example, lateral with respect to the front of the foot and vertical with respect to the instep and the plantar arch. It is likewise the case with the liner which forms the object of U.S. Pat. No. 4,182,056, in which the cavity, adapted to adjust itself to the foot, extends under the plantar surface of the foot.

Furthermore, both in the embodiment of the liner according to French Patent No. 2,056,381, as well as in the case of U.S. Pat. No. 4,182,056, the static position of the foot can be distorted during the injection if the skier rests more on the interior or on the exterior of the foot. In such a case, by virtue of the pressure and/or expansion of the injected product, the adjustment of the liner is then accentuated in the zones of the plantar surface upon which the skier does not rest or upon which the skier rests less than other zones.

Another embodiment of an adjustment of the foot in a liner is proposed in French Patent No. 1,412,280 which discloses the arrangement of a plurality of small cushions corresponding to the portions of the foot to be supported. The plantar zone of the foot is protected from an overly tight adjustment. On the other hand, such a construction of the support elements of the foot is relatively complicated by virtue of the plurality of small cushions. Furthermore, the small cushions are randomly removable and are not associable with the internal foot retention apparatus which are known, such as those described in French Patent No. 2,345,097 and PCT Published Application No. 7900770, for example.

French Patent No. 2,107,590 discloses a liner which includes a filling cavity which is positioned only on the rear portion of the foot, while the front portion of the liner is preshaped at its anterior and not subjected to the adjustment by injection in the cavity. The adaptation of such a liner to the foot of the skier occurs first by the shaping of the front portion, for example on a shoe tree, then by injection of the filling product in the cavity of the rear portion of the foot then introduced into the boot. This relatively careful adaptation process requires a plurality of manipulations requiring a certain non-negligible time for execution and, likewise, an elevated operational cost.

SUMMARY OF THE INVENTION

The present invention is directed to a boot liner which includes an exterior envelope including a sole portion and an internal peripheral groove, and an interior envelope positionable within the exterior envelope of the liner. The interior envelope includes a sole portion having a peripheral edge, wherein the peripheral edge is at least partially received within the internal peripheral groove of the exterior envelope for retention of the sole portion therein.

The boot liner of the present invention is preferably intended for use with a rear-entry ski boot. Such a ski boot can, for example, include a foot retention device, such as, for example, a distribution plate located above the instep of the foot, connected to a cabling system for applying an adjustable force thereto. The boot liner of the present invention further includes a cavity located between at least respective portions of the exterior envelope and the interior envelope when the interior envelope is positioned within the exterior envelope and a filling product is received within the cavity.

According to a further aspect of the present invention, the cavity extends from the sole portion of the liner upwardly to at least a position adjacent the upper portion of the foot of the wearer of the boot liner. The boot liner is sealed at the peripheral edge of the sole portion by the engagement of the peripheral edge of the interior envelope within the internal peripheral groove of the exterior envelope.

According to a particular aspect of the present invention, the sealing engagement at the peripheral edge of the sole portion of the boot liner prevents the filling product from expanding beneath the sole portion of the liner.

According to a further aspect of the present invention, the sole portion of the interior envelope is relatively rigid and is connected at its peripheral edge to a sleeve, wherein both the peripheral edge of the sleeve and the sole portion of the interior envelope are at least partially receivably engaged within the internal peripheral groove of the exterior envelope. The sleeve of the interior envelope is preferably comprised of an expandable and permeable material.

According to a still further aspect of the present invention, the exterior envelope is comprised of a relatively impermeable material and at least a portion of the interior envelope, adjacent the cavity, is micro-porous. The micro-porous interior envelope is preferably comprised by a coating on the surface of the interior envelope facing the cavity. The coating can take the form of a polyurethane film. This micro-porous film functions to permit air to pass therethrough, as the filling product is injected within the cavity, but retains the filling product within the cavity.

According to a still further aspect of the present invention, the exterior envelope is comprised of relatively extensible material to substantially conform to the interior configuration of the boot, within which the liner is adapted to be placed, as the filling product is injected into the cavity.

According to a still further aspect of the present invention, the boot liner includes at least one injection orifice in the exterior envelope for entry of the filling product. This injection orifice is preferably positioned at a location on the upper portion of the boot liner which extends beyond the upper portion of the boot when the boot liner is positioned within the boot.

According to a still further aspect of the present invention, the boot liner includes at least one reinforcement element extending over and affixed adjacent a predetermined surface of the interior envelope. This reinforcement element, for example, can be located at a position corresponding to the forward portion of the foot to thereby prevent that portion of the foot from being subjected to the pressure of the filling product.

According to a still further aspect of the present invention, a reinforcement element can also be provided over and affixed adjacent a predetermined surface of the exterior envelope. Such a reinforcement element can be located at a forward position of the leg or at a position corresponding to the heel. Further, the rear-entry boot for which the boot liner can be used can additionally include a separate internal foot retention apparatus.

A further aspect of the present invention includes at least one peripheral rib which extends from a location proximate the injection orifice of the filling product. Preferably, a plurality of such ribs are provided for directing the flow of the filling product from the injection orifice to relatively remote portions of the cavity.

The peripheral ribs for directing the flow of the filling product can be positioned at a forward portion of the boot liner and/or at a rearward portion of the boot liner, including the heel portion.

According to a further aspect of the present invention, the interior envelope includes a surface facing the exterior envelope which is covered with an anti-friction surface for reducing the pressure of the filling product as the filling product is injected within the cavity. Further, with such a configuration, a single injection orifice can be provided.

The present invention can be further characterized as a ski boot liner which is adapted to receive an injected filling product in which the boot liner includes an exterior envelope, an interior sock, an injection cavity positioned between the exterior envelope and the interior sock, which are affixed to one another, wherein the interior sock includes a support sole having a peripheral edge of a predetermined thickness. The exterior envelope includes a wall of a predetermined thickness and a lower portion corresponding to the plantar support zone of the foot, having a retention groove at least partially extending in a manner complementary to the peripheral edge of the support sole of the interior sock. The retention groove is provided in the thickness of the wall of the exterior envelope and at least partially houses the thickness of the peripheral edge of the support sole of the interior sock.

According to a particular aspect of the present invention, the support sole of the interior sock is relatively rigid and is connected to a sleeve which is formed from an extensible and permeable material.

According to a further aspect of the present invention, the sleeve of the interior sock includes a lower edge connected to the peripheral edge of the support sole by means of stitching for ensuring sealing, the lower edge of the sleeve and the peripheral edge of the support sole being housed in the retention groove of the exterior envelope.

The injection cavity of the boot liner of the present invention extends from the support sole to at least partially over an upper portion of the foot.

According to a still further aspect of the present invention, the exterior envelope has an internal wall and the interior sock has a surface which is relatively less than the internal wall surface of the exterior envelope.

According to a still further aspect of the present invention, the interior sock includes a surface adjacent the injection cavity and includes, on the surface, at least one reinforcement extending over a predetermined surface corresponding to at least one substantial zone of the foot to be protected from the force applied by the filling product to be injected into the cavity.

The reinforcement is preferably a distribution plate placed in the front zone of the liner corresponding to the forward portion of the foot of the skier.

According to a still further aspect of the present invention, the exterior envelope can include at least one reinforcement element located adjacent the wall of the exterior envelope. Such a reinforcement can be located in a rear zone corresponding to the heel of the foot and/or located at an upper portion of the liner adjacent, for example, the forward portion of the lower leg.

According to a still further aspect of the present invention, the exterior envelope of the boot liner of the present invention is made from a relatively impermeable material, while the interior sock is made from a relatively permeable material which includes, on the surface adjacent the injection cavity, a micro-porous coating constituting a degasification means for the injection cavity and a stopping means for the filling product at the surface of the sock. The micro-porous coating can be composed of a polyurethane type film.

According to a still further aspect of the present invention, the exterior envelope of the boot liner of the present invention is constituted of a relatively extensible or expandable material adapted to conform to the interior configuration of the shell of the boot under the effect of the pressure of the filling product injected into the boot liner.

According to a still further aspect of the present invention, the exterior envelope of the boot liner of the present invention includes at least one maintenance means adapted to cooperate with at least one constituent element of an internal foot retention apparatus for the boot.

According to a still further aspect of the present invention, the boot liner is usable with a boot having an outer shell, the boot liner including an injection orifice positioned beyond the shell of the boot in the upper forward portion of the boot liner.

Further according to the present invention, the front upper portion of the boot liner is provided with a reinforcement element in the form of a tube or tunnel which mates substantially with the tibial support of the lower leg.

BRIEF DESCRIPTION OF THE DRAWING

The invention is further described with reference to the following text in connection with the annexed drawings showing, by way of non-limiting example, one embodiment of a liner having the various characteristics forming the objects of the invention.

FIG. 7 illustrates a liner ready to be introduced into the boot for its adaptation to the foot of the skier;

FIG. 8 illustrates a stitching detail of the interior liner on the rear edge of the envelope of the liner, in the zone of the heel;

FIG. 9 illustrates, in partial cross-section along line IX—IX of FIG. 7, a detail of the nesting of the plantar support sole of the sock in the peripheral retention groove provided on the internal wall of the exterior envelope;

FIGS. 10 and 11 illustrate, schematically, the relative positions of the various constituent elements of a boot and its liner before and after, respectively, the injection of the filling product for the adaptation to the foot of the skier; and FIG. 12 illustrates, in partial cross-section along line XII—XII of FIG. 11, the nesting detail in the retention groove of the plantar support sole of the interior sock after injection of the filling product.

DETAILED DESCRIPTION OF PREFERRED EMBODIMENTS

Figure 1:
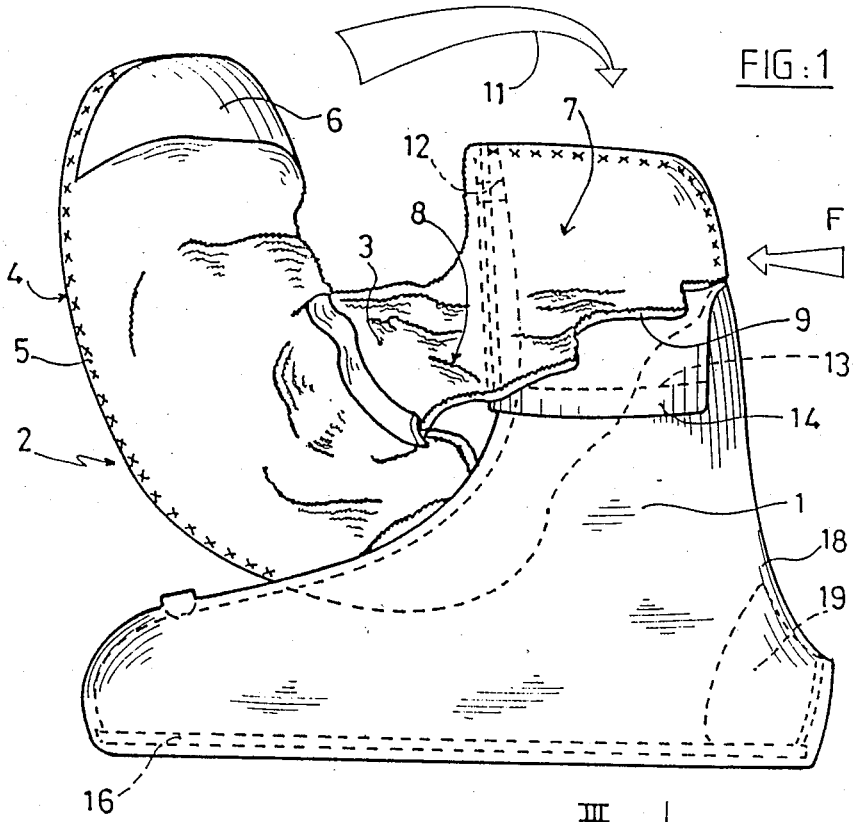
FIG. 1 illustrates, in longitudinal cross-section, a liner according to the invention in the course of assembly.

The present invention is directed to a liner adapted to a single operation for the foot of the skier by injection of a filling product in a cavity which at least partially surrounds the foot while protecting the plantar surface thereof. Furthermore, by virtue of the adaptation possibilities of the exterior envelope of the liner with respect to its positioning within the shell of the boot, the liner is adapted to be used with boot shells which had been originally designed for use with non-injected liners.

According to the invention, the liner is constituted by an exterior envelope having a shape which corresponds substantially to that of the interior of the boot. The interior envelope or sock is constituted by a sleeve and a plantar support sole which is relatively rigid. The sock is placed within the exterior envelope and is affixed thereto by any known process, such as gluing, stitching, welding, etc., on the periphery of the opening for the insertion of the foot in the upper portion of the liner.

According to one characteristic, the injection cavity is constituted by the free space positioned between the exterior envelope of the liner and the wall of the sleeve of the interior sock and is defined, in its lower portion, by the plantar support sole of the liner. This sock nests by means of the edge of the plantar support sole in a peripheral retention groove formed in the internal wall of the exterior envelope of the liner in the lower zone thereof. On the other hand, it is possible to provide a support sole cooperating with a retention groove provided solely on a portion of the periphery of the sole.

This arrangement prevents the flow of the filling product under the plantar zone of the foot and permits, in particular, the pre-mounting of the sleeve of the sock on the support sole. The support sole can be provided, beginning with an anatomic sole which is shapeable or preformed. The peripheral retention groove provided in the exterior envelope of the liner, and adapted to receive the edge of the sole by at least partial nesting, presents a substantially complementary shape to that of the sole.

According to another characteristic, the sleeve of the interior sock has a surface which is relatively smaller than that corresponding to the space within the external envelope of the liner, and can be formed preferably an extensible or expandable material. Thus, when the plantar support sole of the sock is nested in the retention groove of the external envelope, the wall of the sock is stretched to assume a configuration corresponding substantially to that of the foot. Furthermore, the extension of the wall of the liner provides, prior to injection of the filling product, a free space between the internal wall of the exterior envelope and the sleeve which facilitates the injection of the filling product in the cavity, which is thus defined by avoiding undesirable and unintentional creases.

Still according to the invention, the interior sock can include at least one preformed reinforcement associated at its surface adjacent to the injection cavity to protect at least one sensitive zone of the foot from the injection effect by the adjustment of the filling product and/or to protect it from possible compression.

Likewise, to ensure proper positioning of the exterior envelope of the liner during the injection of the filling product, or further after injection to consolidate at least a portion of the periphery with its introduction opening, a reinforcement element can be associated with the envelope in the concerned zone. This zone can extend, in particular, in the rear portion of the liner corresponding to that of the heel of the foot of the skier.

According to a constructional detail of the liner, the exterior envelope of the liner is formed out of a relatively deformable material such as a polyurethane foam (PU), for example, so as to be able to have it assume a shape like that of the interior of the shell of the boot under the effect of pressure of the filling product injected in the injection cavity simultaneously with the adjustment of the interior sock on the foot of the skier. Furthermore, to allow for the evacuation of the air and/or gas from the injection cavity resulting from the introduction of the filling product, a degasification means is adapted to the wall of the sleeve of the liner.

According to one complementary characteristic of the invention, the degasification means involves employing an extensible material, which is permeable (a permeable texture), for the sleeve, and to furthermore provide, preferably, the adjacent surface of the injection cavity with a micro-perforated (micro-porous) coating. By virtue of the dimensions of its micro-perforations, the coating thus constitutes the degasification means of the injection cavity and the stopping means of the filling product at the corresponding surface of the sleeve of the sock. It is well understood that the dimension of the micro-perforations is related to the viscosity of the filling product. This coating can, for example, be present in the form of a microperforated polyurethane film. Such a film, furthermore, has the advantage of facilitating the injection of the filling product by reducing the friction of the latter against the sock and, consequently, injecting the product without an elevated pressure, by a single orifice which is relatively spaced from certain filling end zones. Preferably, the injection orifice is positioned on the front upper portion of the liner and accessible outside the shell of the boot, which avoids the passage of the injection conduit between the shell and the exterior envelope of the liner.

Still within the object of facilitating the injection of the filling product, the exterior envelope surface adjacent to the injection cavity can preferably be provided, beginning with the injection orifice, with ribs which extend in the direction of the filling end zones. These ribs allow in particular for directing the flow of the product in their direction.

As indicated above, the liner can be adapted to be fitted to ski boots having a rigid shell of the type including internal foot retention apparatus. Thus, for example, at least the front portion of the liner, corresponding to the zone of the upper portion of the foot, can be provided with a retention means and/or foot maintenance means such as a distribution plate positioned facing a cavity or a portion of a cavity which is injected with the filling product.

One embodiment of the liner involves providing an envelope, which is closely affixed to the foot of the skier, by providing an upper which surrounds the lower leg, the upper being able to present a rearward portion which is movable to facilitate the introduction of the foot. Likewise, the liner can include a front portion which closely surrounds the foot to the zone of the heel, and a rear portion, independent from the front portion, adapted to be affixed to the rear spoiler of a ski boot of the rear-entry type. In this latter type of embodiment, the front portion of the liner can be provided with a small tongue in the zone of the heel so as to facilitate the extraction of the portion of the liner from the boot and/or the introduction of the foot.

In FIG. 1 there is shown a liner according to the invention in the course of assembly, so as to best illustrate the different constituent elements of the liner and, in particular, the respective position of the interior envelope or sock 2 with respect to the exterior envelope 1, before its introduction into the latter. In this preassembly position, the interior sock 2 is connected, by stitching, to the exterior envelope 1, or by any other known process, only in the upper zone of upper 7 of the latter and is then introduced by being turned around its stitching, as indicated by the arrow 11, in the envelope. In this embodiment of the liner, the exterior envelope 1 is constructed from a single piece but can, if desired, also be formed from a plurality of pieces or elements. The embodiment of the exterior envelope made from a single element is preferred since it avoids assembly operations and guarantees optimum sealing. To this end, a material formed out of a polyurethane foam, for example, is preferred.

The interior sock 2 is composed of a sleeve 3 adapted to envelop the foot, and of a plantar support sole 4, which is relatively rigid. The sleeve 3 and sole 4 are connected to one another on the peripheral edge 5 of the sole by known means such as stitching or gluing. To ensure the adaptation of the sleeve 3 to the foot of the skier during the injection, the sleeve is formed from a stretchable and permeable material, and possibly compressible, for reasons of comfort of the foot. Furthermore, and according to another characteristic of the invention, wall 9 of sleeve 3 constituted from this material, is provided, on its surface 8, which after assembly becomes adjacent to the injection cavity 10 (seen in FIGS. 5, 6 and following figures) with a micro-perforated coating 25. This coating, made from a film of polyurethane, for example, provides the degasification means of the injection cavity, and constitutes a barrier against possible infiltration of the filling product into the wall 9 of the sleeve.

Furthermore, in the illustrated embodiment of the sock, a preformed reinforcement such as a shell 6 is, furthermore, applied at the end of the front portion of sleeve 3 by gluing, for example, to protect the corresponding zone at the end of the foot of the skier from the effects of too tight an adjustment which can result from the injection.

According to the invention, the exterior envelope 1 of the liner includes, in its lower portion corresponding to the plantar support zone, a peripheral retention groove 16 adapted to receive, by nesting the peripheral edge 5 of the plantar support sole 4 of the inner sock 2.

Figure 2:
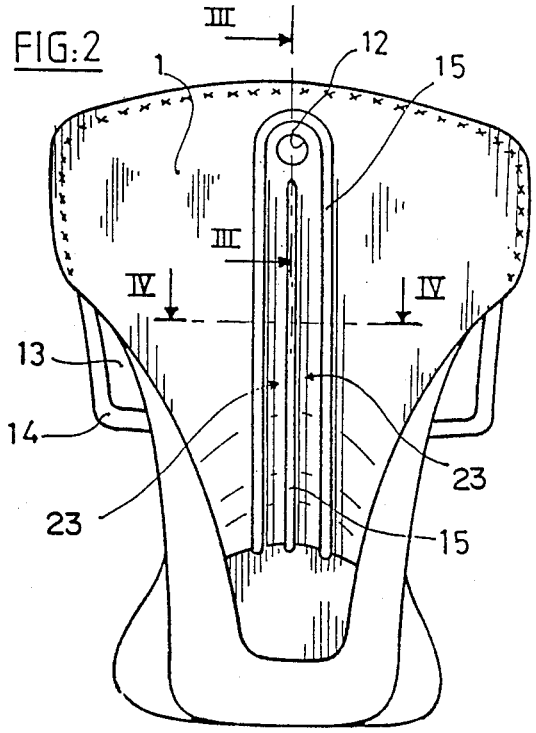
FIG. 2 illustrates the liner of FIG. 1 in elevation in direction F, and shows an embodiment detail of the internal wall of the exterior envelope thereof.
Figure 3:
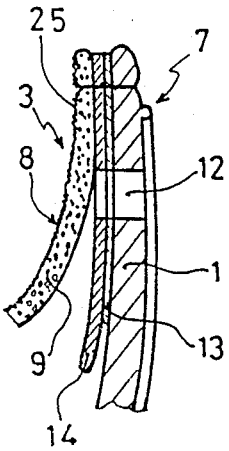
FIG. 3 illustrates, in cross-section along line III—III of FIG. 2, an embodiment detail of the assembly of the constituent portions of the liner.
Figure 4:
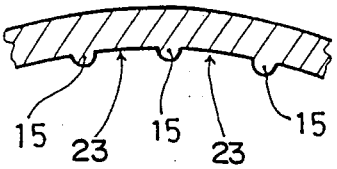
FIG. 4 illustrates, in cross-section along line IV—IV of FIG. 2, the detail of the shape of the injection channels of the filling product.
Figure 5:
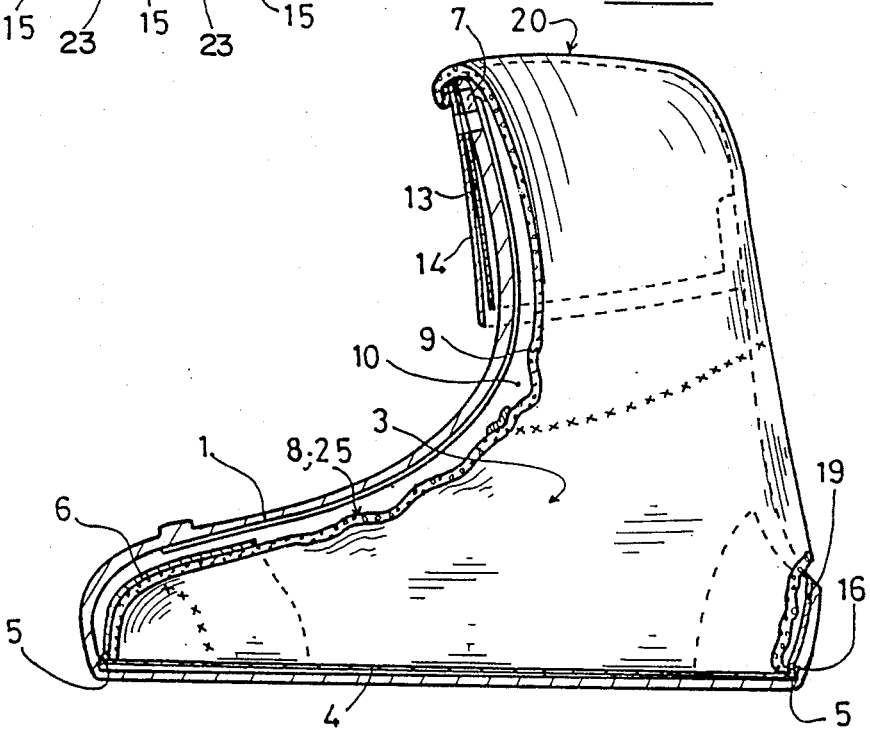
FIG. 5 illustrates the liner of FIG. 1, in longitudinal cross-section, with the interior liner introduced into the exterior envelope.
Figure 6:
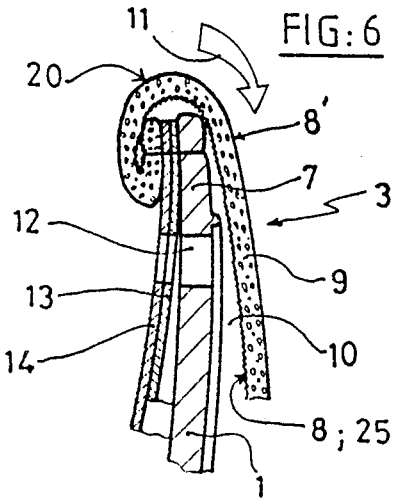
FIG. 6 illustrates the detail of FIG. 3 after the turning back of the interior sock in the liner envelope, as is seen in FIG. 5.

In a known manner, illustrated in FIGS. 1 and 3, the upper portion of upper 7 of the exterior envelope 1 of the liner can be provided with a reinforcement element 13, in the form of a tunnel which substantially mates with the shape of the tibial support of the lower leg, and with a flap 14, which is superimposed on element 13, which is adapted, among other things, to serve as protection from water and/or from the abrasive action of the snow, which is possible in this zone corresponding to the upper portion of the ski boot. As shown in FIG. 3 in particular, the order of superimposition of the constituent elements of the liner is seen at the level of its front upper portion, before the interior sock 2 is turned back. Successively, this order includes the wall 9 of sleeve 3, the protection flap 14, the reinforcement element 13, and the wall of exterior envelope 1 of the liner. These elements are connected by stitching along the length of the corresponding edge of the exterior envelope 1. Towards the exterior, sleeve 3, in its preassembled position, has a surface 8 of its wall 9, which surface 8 is adjacent to the injection cavity 10 in the assembled position of the interior sock 2 (FIG. 5). To allow for the injection of the filling product, an injection orifice 12 is formed through flap 14, reinforcement 13, and the wall of exterior envelope 1 of the liner. The latter preferably includes, as shown in FIGS. 2 and 4, ribs 15 which extend from the injection orifice 12 in the direction of the front end portion of the liner corresponding substantially to the zone of the front of the foot of the skier. These ribs 15 define channels 23 which serve as guides for the filling product, which favor the flow of the latter in the direction of their orientation.

To consolidate, if desired, the envelope over at least a portion of the periphery 18 of its introduction opening of the foot, and in particular in its rear -one corresponding to the heel, a reinforcement element 19, having a shape substantially complementary to the zone, can be associated and affixed to the envelope.

Successively after preassembly of the liner which has just been described with reference to FIGS. 1–4, the interior sock 2 is introduced into the exterior envelope 1 (FIGS. 5 and 6) by turning back sleeve 3, such as shown by arrow 11, around its stitching in the upper zone of upper 7 of envelope 1. Such as shown in detail in FIG. 6, the upper edge 20 of the liner thus has a bead whose exterior appearance is constituted by the other surface 8' of wall 9 of sleeve 3. Surface 8 thus becomes adjacent to the injection cavity 10.

Beginning with this phase of assembly of the liner, and as shown in FIG. 7, the completion of the assembly of the sleeve 3 of the interior sock 2 to the exterior envelope 1, for example, is by further stitching, extending over the entire remainder of periphery 18 of the introduction opening thereof. The injection cavity 10 is thus defined by the free space which exists between the walls of the exterior envelope 1 and of the interior sock 2. An injection tube 21 can be positioned on injection orifice 12 prior to the assembly of sock 2 on envelope 1.

In FIG. 8 there is seen, in a detailed fashion, another possible assembly embodiment by stitching of the interior sock 2 on the envelope 1. Wall 9 of sleeve 3 is, in particular, turned back against periphery 18 of the introduction opening of the envelope by forming a relatively substantial fold to guarantee the sealing with respect to the stitching during the injection. In the present case, the reinforcement element 19 is likewise stitched with the sleeve 3 on the periphery 18 of envelope 1.

The liner, as has just been described in preceding FIGS. 7 and 8, is thus usable in association with a ski boot shell for adaptation to the foot of the skier. According to the invention, the plantar support sole 4 of the sock 2 is adapted to be applied to the corresponding lower portion of the exterior envelope 1 to be nested in the peripheral retention groove 16 thereof by means of its peripheral edge 5, or even with only a portion of this edge. As is seen more clearly in FIGS. 8 and 9, the nesting of edge 5 of support sole 4 includes, likewise, the lower stitched edge 17 of sleeve 3. In the nesting position of support sole 4, the sleeve 3 of the interior sock 2 is spread out and has a shape corresponding approximately to that of the foot. Previously, it was explained that the developed surface of sleeve 3 could furthermore be made smaller than that corresponding to its seat in the exterior envelope 1. In such a case, the sleeve 3 is subjected to an extension which provides a free space already released from the exterior envelope of the liner and avoids possible unwanted and unintentional folds or creases of wall 9 of the sleeve.

Figure 10:
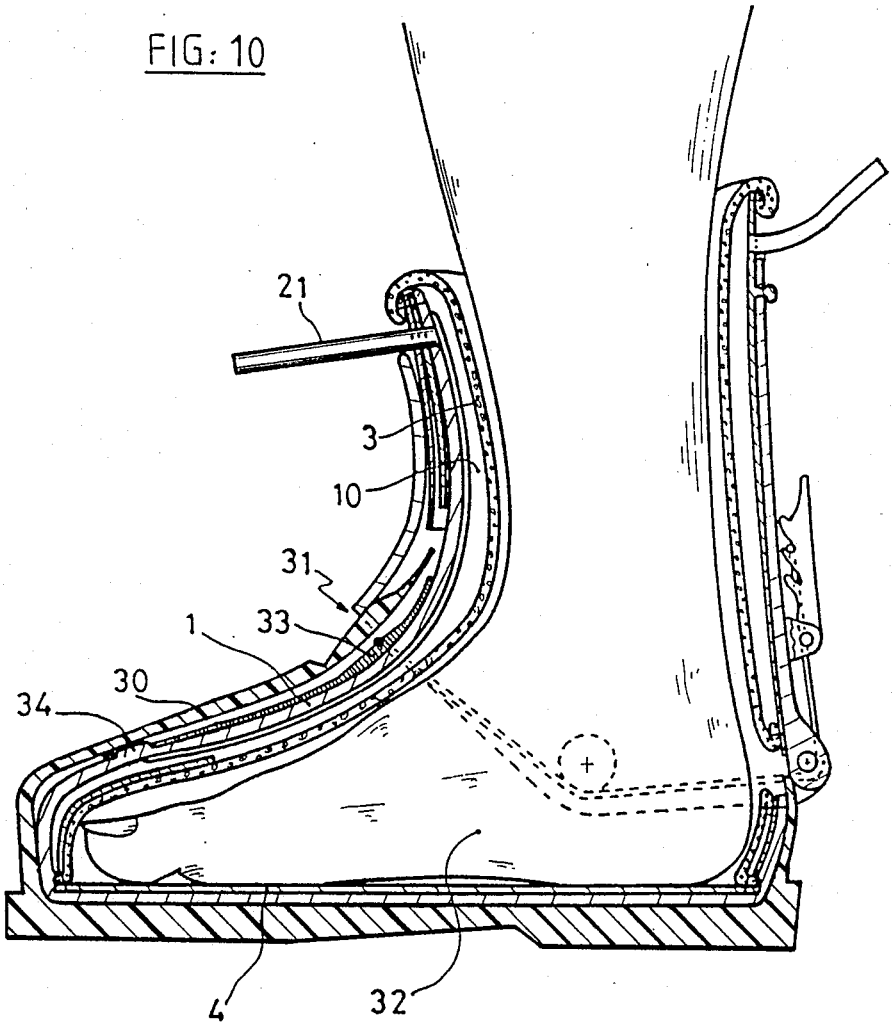

In FIG. 10, the liner is introduced into shell 30 of a ski boot of a known type including, in this example, an internal foot retention apparatus 31. Before injection, the skier places his foot 32 within the liner and applies, in particular, the plantar support sole 4 against the corresponding lower portion of exterior envelope 1. The respective positions of the different constituent elements of the boot and of the liner between them, after insertion of the foot of the skier relative to the boot, creates a certain clearance before injection of the filling product in the injection cavity 10, at least partially surrounding the top of the foot, except in the zone of the plantar support. In effect, by virtue of the relative rigidity of support sole 4, it simultaneously achieves, with the peripheral retention groove 16, both a sealing joint and a positioning nesting of the support sole in the liner, thus defining the extent of injection cavity 10.

The adaptation of the liner to the foot of the skier (FIGS. 11 and 12) is then effected by injection of a filling product through an injection tube 21 which, as previously explained, is preferably situated in the upper portion of the liner which extends beyond shell 30 of the boot. Although a single tube 21 and orifice 12 can be utilized, plural orifices and tubes, alternatively, could also be used as illustrated in FIGS. 10 and 11.

Under the effect of the pressure of the filling product, sleeve 3 of the interior sock mates with and assumes a shape complementary to the shape of the foot in the zones corresponding to those of the cavities positioned facing the zones of the foot. Simultaneously, the exterior envelope 1 of the liner conforms substantially to the shape of its seat in the boot and to the different constituent elements of the internal foot retention apparatus 31 with which it is in constant contact, as, for example, the distribution plate 33. During injection, the filling product furthermore fills portion 24 of the retention groove 16 not filled by the thickness of sole 4 and reinforces the nesting of the plantar support sole 4 as shown in FIG. 12.

The filling product can be of any type, expansible and/or compressible after stabilization and/or polymerization, such as commercially available polyurethane foams, without going beyond the scope of the invention.

Likewise, the interior sock may include any coating which is woven or non-woven adapted to improve the conditions of comfort of the foot and/or its esthetic appearance.

Such a liner can also be used as desired on either rear-entry or front-entry boots, whether or not they are provided with internal foot retention apparatus. It can further be envisioned, as is shown in FIG. 10 for example, to provide exterior envelope 1 of the liner with a maintenance means 34, adapted to cooperate with a constituent element of the foot retention apparatus, such as foot distribution plate 33. Finally, injection orifice 12 can be positioned at any other location in the liner.

Although the invention has been described with reference to the particular means, materials and embodiments, it is to be understood that the invention is not limited to the particulars disclosed and extends to all equivalents within the scope of the claims.

We claim:

1. Ski boot liner adapted to receive an injected filling product, said ski boot liner comprising: an exterior envelope, an interior sock, an injection cavity positioned between said exterior envelope and said interior sock which are affixed to one another, wherein said interior sock comprises a plantar support sole having a peripheral edge of a predetermined thickness, said exterior envelope comprising (i) a wall of a predetermined thickness, and (ii) a lower portion for supporting the plantar support zone of the foot, said exterior envelope having a retention groove at least partially extending in a manner complementary to said peripheral edge of said plantar support sole of said interior sock, said retention grove being provided in said thickness of said wall of said exterior envelope and at least partially housing said thickness of said peripheral edge of said plantar support sole of said interior sock.

2. Ski boot liner according to claim 1 wherein said plantar support sole is relatively rigid, to which is connected a sleeve formed from an extensible and permeable material.

3. Ski boot liner according to claim 2 wherein said sleeve comprises a lower edge connected to said peripheral edge of said support sole by means of stitching for ensuring sealing, said lower edge of said sleeve and said peripheral edge of said support sole being housed in said retention groove by nesting.

4. Ski boot liner according to claim 1 wherein said injection cavity extends, from said plantar support sole to a position of said boot liner at least partially over the upper portion of the foot.

5. Ski boot liner according to claim 1 wherein said exterior envelope has an internal wall and wherein said interior sock has a surface which is relatively smaller than that of said internal wall of said exterior envelope.

6. Ski boot liner according to claim 1 wherein said interior sock comprises a surface adjacent to said injection cavity and includes, on said surface, at least one reinforcement extending over a predetermined surface corresponding to at least one substantial zone of the foot to be protected from a force applied by said product to be injected into said cavity.

7. Ski boot liner according to claim 6 wherein said reinforcement is in the shape of a shell placed in a front zone corresponding to that of the end of the foot of the skier.

8. Ski boot liner according to claim 1 wherein said exterior envelope of said liner comprises at least one reinforcement element located adjacent said wall of said exterior envelope.

9. Ski boot liner according to claim 1 wherein said exterior envelope of said liner is provided, in a rear zone corresponding to that of the heel of the foot, with a reinforcement element located adjacent said wall of said exterior envelope.

10. Ski boot liner according to claim 1 wherein said exterior envelope of said liner is made from a relatively impermeable material, while said interior sock is made from a permeable material which comprises, on said surface adjacent to said injection cavity, a micro-porous coating constituting a degasification means for said injection cavity and a stopping means for said filling product at said surface of said interior sock.

11. Ski boot liner according to claim 10 wherein said micro-porous coating comprises a polyurethane type film.

12. Ski boot liner according to claim 1 usable with a boot having an outer shell, wherein said exterior envelope of said liner is constituted of a relatively extensible material adapted to conform to the interior of said shell of said boot under the effect of pressure of said filling product injected during adaptation to the foot of the skier.

13. Ski boot liner according to claim 1 wherein said exterior envelope of said liner comprises at least one means for maintenance adapted to cooperate with at least one constituent element of an internal foot retention apparatus for said boot.

14. Ski boot liner according to claim 1 usable with a boot having an outer shell, comprising an injection orifice positioned beyond said shell of said boot in an upper front zone of said liner.

15. Ski boot liner according to claim 1 usable with a boot having an outer shell, said liner comprising a front upper portion provided with a reinforcement element in the form of a tunnel which mates substantially with the shape of the tibial support of the lower leg in the zone corresponding to said shell of said boot.

16. Ski boot liner according to claim 1 wherein said plantar support sole of said interior sock is adapted to be affixed to said exterior envelope while being positioned within said exterior envelope.

17. Ski boot liner according to claim 1 wherein said plantar support sole of said interior sock is separate from said lower portion of said exterior envelope, and wherein said interior sock is adapted to be received within said exterior envelope and is adapted to be engaged by said lower portion of said exterior envelope.

18. Ski boot liner according to claim 1 wherein, between said interior sock and said exterior envelope, a cavity is formed which is adapted to receive an injected product, said cavity extending to the junction between said interior sock and said exterior envelope at said peripheral edge of said interior sock and said retention groove of said exterior envelope.

19. A boot liner comprising:

an exterior envelope comprising an internal peripheral groove; and an interior envelope positionable within said exterior envelope, comprising a sole portion having a peripheral edge, wherein said peripheral edge is at least partially receivably engaged within said internal peripheral groove of said exterior envelope while said sole portion is received within said exterior envelope for retention of said sole portion within said exterior envelope.

20. The boot liner of claim 19 adapted for use with a ski boot.

21. The boot liner of claim 19 adapted for use with a rear-entry ski boot.

22. The boot liner of claim 19 in combination with a ski boot.

23. The boot liner of claim 19 in combination with a rear-entry ski boot.

24. The boot liner and ski boot of claim 23 further comprising a foot retention device.

25. The boot liner and ski boot of claim 24 wherein said foot retention device comprises a force distribution plate positioned within said ski boot for application of a force against an upper portion of said foot.

26. The boot liner of claim 19 further comprising a cavity located between at least respective portions of said exterior envelope and said interior envelope when said interior envelope is positioned within said exterior envelope for receiving a filling product.

27. The boot liner of claim 26 wherein said cavity extends from said sole portion to at least a position adjacent an upper portion of the foot of the wearer of said boot liner, said boot liner being sealed at said peripheral edge of said sole portion by said receivable engagement of said peripheral edge of said interior envelope within said internal peripheral groove of said exterior envelope.

28. The boot liner of claim 27 further comprising a filling product for injection within said cavity, said receivable engagement of said peripheral edge of said interior envelope within said internal peripheral groove of said exterior envelope preventing said filling product from moving beneath said sole portion of said interior envelope.

29. The boot liner of claim 27 further comprising a sleeve having a peripheral edge connected to said sole portion at said peripheral edge of said sole portion, wherein both said peripheral portions of said sleeve and said sole portion are at least partially receivably engaged within said internal peripheral groove of said exterior envelope.

30. The boot liner of claim 29 wherein said sole portion is relatively rigid and said sleeve is comprised of an expandable and permeable material.

31. The boot liner of claim 26 said exterior envelope is relatively impermeable and at least a portion of said interior envelope adjacent said cavity is micro-porous.

32. The boot liner of claim 31 said at least a portion of said interior envelope adjacent said cavity which is micro-porous comprises a coating on said interior envelope.

33. The boot liner of claim 32 wherein said coating comprises a polyurethane film.

34. The boot liner of claim 31 wherein said at least a portion of said interior envelope adjacent said cavity which is micro-porous functions to permit air to pass therethrough but to retain said filling product thereagainst.

35. The boot liner of claim 31 wherein said exterior envelope is comprised of a relatively extensible material to substantially conform to the interior shape of a boot, within which said liner is adapted to be placed, as said filling product is injected into said cavity.

36. The boot liner of claim 26 further comprising at least one injection orifice in said exterior envelope for entry of said filling product.

37. The boot liner of claim 36 wherein said at least one injection orifice is adapted to be positioned beyond the upper edge of a boot when said boot liner is effectively engaged within said boot.

38. The boot liner of claim 26 wherein said interior envelope and said exterior envelope comprise respective upper portions, and wherein said interior envelope and said exterior envelope are connected and effectively sealed at said respective upper portions.

39. The boot liner of claim 19 further comprising at least one reinforcement element extending over and affixed adjacent a predetermined surface of interior envelope.

40. The boot liner of claim 39 at least one reinforcement element is located at a position corresponding to a forward portion of the foot of a wearer of said boot liner.

41. The boot liner of claim 19 further comprising at least one reinforcement element extending and affixed adjacent a predetermined surface of said exterior envelope.

42. The boot liner of claim 41 wherein at least one reinforcement element is located at a position corresponding to a forward portion of the leg of the wearer of said boot liner.

43. The boot liner of claim 41 wherein at least one reinforcement element is located at a position corresponding to the heel of the foot of the wearer of said boot liner.

44. The boot liner of claim 19 further comprising an element located on said exterior envelope for cooperation with an internal foot retention apparatus of a boot within which said boot liner is to be placed.

45. The boot liner of claim 36 wherein said exterior envelope comprises an internal surface including at least one peripheral rib extending from a location proximate an injection orifice.

46. The boot liner of claim 45 wherein said at least one peripheral rib comprises a plurality of substantially parallel ribs extending from a location proximate an injection orifice.

47. The boot liner of claim 19 wherein said plantar support sole of said interior sock is affixed to said exterior envelope while being positioned within said exterior envelope.

48. The boot liner of claim 19 wherein said plantar support sole of said interior sock is separate from said lower portion of said exterior envelope, and wherein said plantar sole of said interior sock is adapted to be supported by said lower portion of said exterior envelope.

49. The boot liner of claim 19 wherein, between said interior envelope and said exterior envelope, a cavity is formed which is adapted to receive an injected product, said cavity extending to the junction between said interior sock and said exterior envelope at said peripheral edge of said interior sock and said peripheral groove of said exterior envelope.

50. A boot liner comprising:

an interior envelope;

an exterior envelope defining a cavity between said interior envelope and said exterior envelope, wherein said exterior envelope further comprises at least one orifice for injection of a filling product into said cavity for applying a force against a foot placed within said interior envelope of said boot liner; and said exterior envelope further comprising an internal surface having a groove thereon for directing the flow of said filling product from said at least one orifice to a portion of said cavity spaced from said orifice.

51. The boot liner of claim 50 wherein said groove is defined by a plurality of ribs and wherein said plurality or ribs are located on a portion of said internal surface of said exterior envelope corresponding to a forward portion of a wearer's foot within said boot liner.

52. The boot liner of claim 50 wherein said groove is defined by a plurality of ribs and wherein said plurality of ribs are located on a portion of said internal surface of said exterior envelope corresponding to the heel of a wearer's foot within said boot liner.

53. The boot liner of claim 50 wherein said at least one orifice comprises only one orifice.

54. The boot liner of claim 53 wherein said one orifice is located in a portion of said exterior envelope corresponding to a front portion of a foot of a wearer of said boot liner.

55. The boot liner of claim 50 wherein said interior envelope has an internal surface, at least a portion of which is covered with an anti-friction surface.

56. The boot liner of claim 50 wherein said interior envelope and said exterior envelope are sealed to prevent said filling product from moving beneath a portion of said boot liner corresponding to the sole of the foot of a wearer of said boot liner.

57. The foot liner of claim 50 wherein said groove is positioned on said internal surface of said exterior envelope to direct said flow of said filling product along said internal surface.

* * * * *

UNITED STATES PATENT AND TRADEMARK OFFICE

CERTIFICATE OF CORRECTION

PATENT NO. : 4,910,889

DATED : March 27, 1990

INVENTOR(S) : L. BONAVENTURE et al.

It is certified that error appears in the above-identified patent and that said Letters Patent is hereby corrected as shown below:

column 8, line 63, change "one" to —zone—;
column 10, line 58, change "grove" to —groove—;
column 13, line 1, insert —wherein— after "26";
column 13, line 4, insert —wherein— after "31";
column 13, line 35, insert —said— after "of";
column 13, line 37, insert —wherein— after "39";
column 14, line 36, change "or" to —of—; and
column 14, line 58, change "foot" to —boot—.

Signed and Sealed this

Twenty-eighth Day of April, 1992

*Attest:*

HARRY F. MANBECK, JR.

*Attesting Officer*

*Commissioner of Patents and Trademarks*